US008992282B2

(12) United States Patent
Desent et al.

(10) Patent No.: US 8,992,282 B2
(45) Date of Patent: Mar. 31, 2015

(54) PIVOTING FRAME ADJUSTABLY SUPPORTING A FLEXIBLE RAMP AND METHODS THEREOF

(75) Inventors: Nash Desent, North Kingstown, RI (US); John Boyce, Willington, CT (US)

(73) Assignee: Hasbro, Inc., Pawtucket, RI (US)

( * ) Notice: Subject to any disclaimer, the term of this patent is extended or adjusted under 35 U.S.C. 154(b) by 68 days.

(21) Appl. No.: 13/563,368

(22) Filed: Jul. 31, 2012

(65) Prior Publication Data

US 2014/0038488 A1 Feb. 6, 2014

(51) Int. Cl.

| | |
|---|---|
| ***A63H 29/08*** | (2006.01) |
| ***A63H 17/00*** | (2006.01) |
| ***A63H 18/02*** | (2006.01) |
| ***A63H 18/06*** | (2006.01) |

(52) U.S. Cl.

CPC ..... *A63H 17/008* (2013.01); *A63H 18/026* (2013.01); *A63H 18/06* (2013.01)

USPC ..... 446/168; 446/227

(58) Field of Classification Search

CPC ... A63H 17/008; A63H 18/06; A63H 18/026; A47C 1/00; A47C 1/14; A47C 1/16; A47C 4/40; A47C 4/46; A47C 4/0028; A47C 4/30

See application file for complete search history.

(56) References Cited

U.S. PATENT DOCUMENTS

| | | | | |
|---|---|---|---|---|
| 2,467,909 | A * | 4/1949 | Rechler | 297/27 |
| 2,627,899 | A * | 2/1953 | Grotefend | 297/23 |
| 3,112,953 | A * | 12/1963 | Raver | 297/18 |
| 4,129,916 | A | 12/1978 | Schlesinger et al. | |
| 4,754,999 | A * | 7/1988 | Kain | 297/256.14 |
| 6,350,174 | B1 | 2/2002 | Halford et al. | |
| 6,471,288 | B2 * | 10/2002 | Alexander, Jr. | 297/56 |
| 6,776,685 | B2 | 8/2004 | Reisher et al. | |
| 2005/0287914 | A1 | 12/2005 | Sheltman et al. | |
| 2005/0287915 | A1 | 12/2005 | Sheltman et al. | |
| 2005/0287916 | A1 | 12/2005 | Sheltman et al. | |
| 2005/0287917 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2011/0021110 | A1 | 1/2011 | Hippely et al. | |

* cited by examiner

*Primary Examiner* — Vishu Mendiratta
(74) *Attorney, Agent, or Firm* — Perry Hoffman

(57) ABSTRACT

A toy which simply yet uniquely varies the height and curvature of a flexible ramp uniquely supported on a pivoting ramp frame. The toy includes a frame for resting on a horizontal surface, spaced apart horizontally and extending upwardly from the frame defining an open area therebetween above the frame, and first and second pivoting assemblies at the frame engaging first and second arm members for adjustably pivoting the arm members between varying angles with respect to the frame. A bendable ramp is adjustably supported at the frame, secured to the arm members and sitting in the open area defined by the arm members.

19 Claims, 5 Drawing Sheets

PIVOTING FRAME ADJUSTABLY SUPPORTING A FLEXIBLE RAMP AND METHODS THEREOF

BACKGROUND OF THE INVENTION

1. Field of the Invention

The present invention relates to toy ramps, and more particularly to a toy ramp which simply yet uniquely varies the height and curvature of a flexible ramp surface uniquely supported on a pivoting ramp frame and adjusted though rotation of a single knob member at the frame. The invention also relates to methods for pivoting a ramp frame and adjusting the height and curvature of a bendable ramp surface uniquely supported on the frame.

2. Background of the Invention

There are many known toy ramp and track structures for toy vehicles incorporating ramp surfaces, tracks and bases. Many of the known ramps and tracks have bendable supports and some have adjusting members, but none include a pivoting frame adjustably supporting a bendable ramp surface.

Some known ramps have a ramp surface that adjusts to varying heights, as exemplified and disclosed in expired U.S. Pat. No. 4,129,916, issued Dec. 19, 1978 to Schlesinger et al. A ramp member in Schlesinger is supported on an adjustable suspensory frame which has movable connections that adjust the suspensory frame. The suspensory frame includes tubular side rails and supporting posts with extension bars mounted in telescoping relationship with the side rails and supporting posts, respectively. The extension bars of the suspensory frame adjust the angle of incidence of the ramp member with respect to the frame as they telescope in and out of the side rails and supporting posts.

Another known ramp that adjusts the pathway or launch trajectory of a toy vehicle riding on the ramp is exemplified and disclosed in US Patent Application Publication No. 2011/0021110 A1 Jan. 27, 2011 to Hippely et al. A ramp member is secured to a base which has a plurality of interaction sites. The ramp member includes a supporting arm that includes a tip which is alternately positioned into one of the many interaction sites altering the pathway or launch trajectory of a toy vehicle supported on the ramp member as the tip is moved to alternative interaction sites.

There is also a known toy vehicle ramp that can reversibly collapse, altering the height of the ramp when a load heavier that a toy vehicle is applied, as exemplified and disclosed in U.S. Pat. No. 6,776,685, issued Aug. 17, 2004, to Reisher et al. The ramp includes a resiliently flexible sheet panel and a pair of stiffer support members, with each support member including a plurality of support points. The plurality of support points are arranged to define a channel in which a lateral edge portion of the sheet panel is slidingly received thus adjusting the height of the panel/ramp in the supports. Elastic members extend between the support members beneath the sheet panel to hold the ramp together. The flexible sheet panel collapses without damage to its parts and the bands stretch when a load heavier than a toy vehicle is applied.

Another known toy roll-up skateboard ramp for use with finger boards or miniature skateboards is exemplified and disclosed in U.S. Pat. No. 6,350,174, issued Feb. 26, 2002 to Halford, et al. Halford discloses a miniature flexible resilient sheet roll-up received upon the supporting frame consisting of side-rails and platform elements. The side-rails can be in either an open extended position for receiving the flexible sheet or in a collapsed compact configuration for storing.

There are also several known vehicle track sets including a portion of the track in which the vehicle travels a path the includes a flexible multi-apertured panel held by a support structure, as exemplified in a numerically consecutive series of patents similar to US Patent Application No. 2005/0287914 through US2005/0287919 to Sheltman et al. each having been allowed to become abandoned. A track segment of the track set is coupled to the panel forming a U-shaped portion to join together with a straight track segment.

Significantly, known toy ramp and track structures do not include a pivoting frame adjustably supporting a bendable ramp surface which simply yet uniquely varies the height and curvature of the bendable ramp surface through rotation of a single knob member at the frame. It would be desirable to provide a toy having a frame for resting on a horizontal surface, first and second arm members each extending upwardly from the frame, linked together and being horizontally spaced apart from one another on the frame to define an open area therebetween above the frame. First and second pivoting assemblies at the frame mechanically engage first and second arm members, respectively, for adjustably pivoting first and second arm members between varying angles with respect to the frame. A bendable ramp adjustably supported at the frame and secured to the arm members, sits in the open area defined by the arm members. The ramp including a ramp surface which adjusts between a first position, which is nearly vertical with respect to the frame when the first pivoting assembly is rotated to a first location, and to a second position when the first pivoting assembly is rotated to a second location.

SUMMARY OF THE INVENTION

The present invention addresses shortcomings of the prior art to provide a toy which simply yet uniquely varies the height and curvature of a flexible ramp surface uniquely supported on a pivoting ramp frame.

In one embodiment of the invention, a toy includes a frame for resting on a horizontal surface, a first and a second arm member each extending upwardly from the frame, said first and second arm members being horizontally spaced apart from one another on the frame to define an open area therebetween above the frame. The toy further includes a first pivoting assembly at the frame mechanically engaging the first arm member for adjustably pivoting the first arm member between varying angles with respect to the frame, and a second pivoting assembly at the frame mechanically engaging the second arm member for adjustably pivoting the second arm member between varying angles with respect to the frame. A bendable ramp is adjustably supported at the frame, secured to the arm members and sitting in the open area defined by the arm members, the ramp including a ramp surface that adjusts between a first position, which is nearly vertical with respect to the frame when the first pivoting assembly is rotated to a first location, and a second position when the first pivoting assembly is rotated to a second location.

In another embodiment of the invention, the second position of the bendable ramp surface is nearly horizontal with respect to the frame, and in another embodiment, a stop mechanism is further included at the frame mechanically engaging the first pivoting assembly for locking the first pivoting assembly into position and securing the arm members at a desired angle with respect to the frame. In another embodiment, the first pivoting assembly further comprises a knob member with a button element contained therein for releasing the stop mechanism to freely rotate the first pivoting assembly to reposition the first arm member and linked second arm member with respect to the frame.

In another embodiment, the stop mechanism further comprises a pin projecting from a lever element in mechanical communication with the first pivoting assembly, and in another embodiment, a slot is further included at the frame for containing the pin and limiting the pin rotation to between 0 and 45 degrees. In yet another embodiment of the invention, the bendable ramp comprises a stiff sheet of flexible plastic stretched out and secured to a first end of the frame opposite an end in mechanical communication with the first and second arm members, and the plastic is further secured to second ends of the first and second arm members together, opposite ends in mechanical communication with the frame.

In another embodiment of the invention, a two piece rod shaped clamp is further included at the second ends of the first and second arm members for securing the flexible ramp to the first and second arm members, and in another embodiment, a top plate and a bottom plate are further included at the first end of the frame for capturing the flexible ramp and securing the ramp to the first end of the frame. In yet another embodiment, a goal post assembly is further included including lights, sounds and IR sensors which are activated when a toy vehicle launched from the flexible ramp passes through the goal posts.

In one embodiment of the invention, a toy includes a frame for resting on a horizontal surface, a first and a second arm member each extending upwardly from the frame, said first and second arm members being horizontally spaced apart from one another on the frame to define an open area therebetween above the frame. The toy further includes a first pivoting assembly at the frame mechanically engaging the first arm member for adjustably pivoting the first arm member between varying angles with respect to the frame, a second pivoting assembly at the frame mechanically engaging the second arm member for adjustably pivoting the second arm member between varying angles with respect to the frame, and a stop mechanism at the frame mechanically engaging the first pivoting assembly for locking the first pivoting assembly into position and securing the arm members at a desired angle with respect to the frame. A bendable ramp is adjustably supported at the frame, secured to the arm members and sitting in the open area defined by the arm members, the ramp including a ramp surface adjusts between a first position, which is nearly vertical with respect to the frame, when the first pivoting assembly is rotated to a first location, and to a second position, which is nearly horizontal with respect to the frame, when the first pivoting assembly is rotated to a second location.

In another embodiment of the invention, the pivoting assembly further includes a knob member for releasing the stop mechanism to freely rotate the first pivoting assembly and reposition the first arm member with respect to the frame. In another embodiment, the stop mechanism further includes a pin projecting from a lever element in mechanical communication with the first pivoting assembly, and in another embodiment, a linkage connecting together first and second arm members such that the arm members move in unison is further included.

In another embodiment, a slot is further included at the frame for containing the pin and limiting the pin rotation to between 0 and 45 degrees for maintaining the first pivoting assembly at a desired angle with respect to the frame. In yet another embodiment, the bendable ramp includes a stiff sheet of flexible plastic stretched out and secured to a first end of the frame, opposite an end in mechanical communication with the first and second arm members, and the plastic is further secured to second ends of the first and second arm members together, opposite ends in mechanical communication with the frame.

In another embodiment of the invention, a method for adjusting a ramp frame and the height and curvature of a bendable ramp surface supported on the frame, includes the steps of providing a frame for resting on a horizontal surface, providing a first and a second arm member each extending upwardly from the frame, said first and second arm members being horizontally spaced apart from one another on the frame to define an open area therebetween above the frame. Further provided is a first pivoting assembly at the frame mechanically engaging the first arm member for adjustably pivoting the first arm member between varying angles with respect to the frame, a second pivoting assembly at the frame mechanically engaging the second arm member for adjustably pivoting the second arm member between varying angles with respect to the frame, a stop mechanism at the frame mechanically engaging the first pivoting assembly locking the first pivoting assembly into position and securing the arm members at a desired angle with respect to the frame, and a bendable ramp adjustably supported at the frame, secured to the arm members and sitting in the open area defined by the arm members, the ramp including a ramp surface. The ramp surface adjusts between a first position, which is nearly vertical with respect to the frame, when the first assembly is rotated to a first location, and to a second position when the first pivoting assembly is rotated to a second location.

In another embodiment of the invention, the second position of the bendable ramp surface is nearly horizontal with respect to the frame. In another embodiment, the pivoting assembly further includes a knob member with a button element contained therein for releasing the stop mechanism to freely rotate the first pivoting assembly to reposition the first arm member and linked second arm member with respect to the frame. In another embodiment, a linkage connecting together first and second arm members such that the arm members move in unison is further included.

In yet another embodiment, the stop mechanism further includes a pin projecting from a lever element in mechanical communication with the first pivoting assembly. In still yet another embodiment, a further step includes providing a slot at the frame for containing the pin and limiting the pin rotation to between 0 and 45 degrees for maintaining the first pivoting assembly at a desired angle with respect to the frame. In another embodiment, the bendable ramp further includes a stiff sheet of flexible plastic stretched out and secured to a first end of the frame opposite an end in mechanical communication with the first and second arm members, and the plastic is further secured to second ends of the first and second arm members together, opposite ends in mechanical communication with the frame.

Briefly the present inventions provide a unique toy that varies the height and curvature of a bendable ramp adjustably supported on a pivoting frame. A pair of arm members extend from the frame and mechanically engage a pair of pivoting assemblies which adjusts the arm members to varying angles with respect to the frame. The ramp is secured to the frame and the extending arm members and sits in an open area defined by the arm members above the frame. The ramp includes a ramp surface that adjusts between a first position which is nearly vertical with respect to the frame and a second position which is nearly horizontal with respect to the frame.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope to the present invention.

Figure 1:
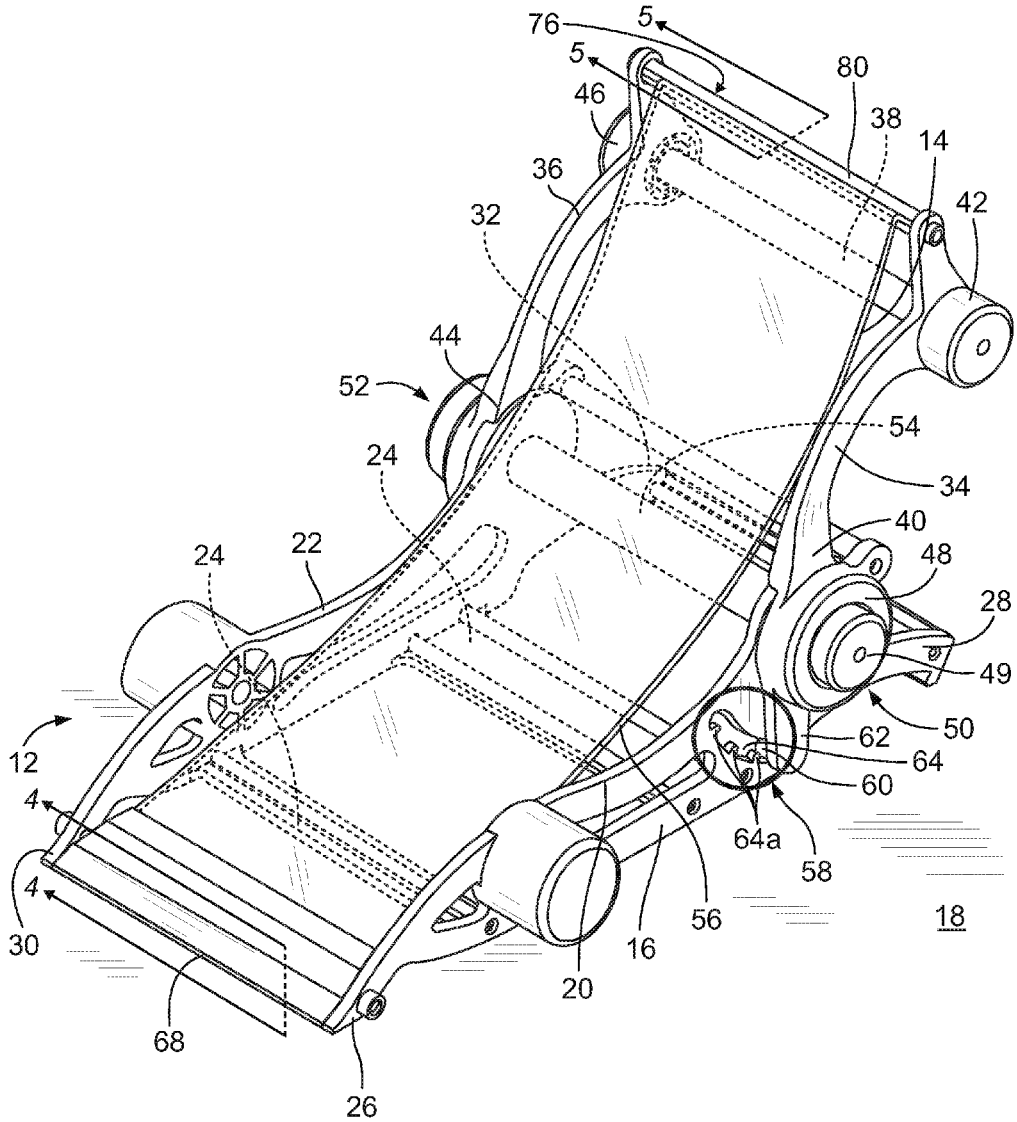
FIG. 1 is a perspective view of a toy of the present invention illustrating a bendable ramp attached to a pivoting frame and secured to a first arm and a second arm extending from the frame.

A combined toy 12, as seen in FIG. 1, is generally seen to include a flexible ramp 14 uniquely supported on a pivoting ramp frame 16 which simply yet uniquely varies the height and curvature of the flexible ramp 14. The frame 16, for resting on a horizontal surface 18, supports the flexible ramp 14 which adjusts between a nearly vertical position and a nearly horizontal position.

The frame 16 is generally seen to include a first support member 20 and a second support member 22 spaced horizontally from each other, each resting on the horizontal surface 18, and defining an open area therebetween above the horizontal surface, as seen in FIG. 1. Two or more linkages 24 connect together first and second support members, 20 and 22 respectively. In the present described embodiment, the first support member 20 has a first end 26 and a second end 28, and the support member 20 tapers down toward the horizontal surface 18 at both ends 26 and 28, giving added stability and support to frame 16. Likewise, second support member 22 has a first end 30 and a second end 32, and support member 22 tapers down toward the horizontal surface 18 at both ends 30 and 32 also for added stability.

In the present described embodiment, support members, 20 and 22, are each designed as one single element, however it is also contemplated that each support member, 20 and 22 can be designed as two parts, which slide past each other to vary the horizontal length of each supporting member. One of the parts of the supporting member can include a slot and the other part can include a pin to ride in, and additionally lock, into the slot as the two parts of the supporting member slide past one another.

The frame 16 is generally manufactured from a heavy duty rigid plastic material which is simple and inexpensive to manufacture into any desired shape and can easily include fun colors and patterns which are appealing to young users. In the present described embodiment, each supporting member, 20 and 22, includes fun graphics and/or protrusions which are shaped to resemble race car wheels.

A first and a second arm member, 34 and 36, respectively, extend upwardly from the frame 16, as seen in FIG. 1. The first and second arm members, 34 and 36, respectively, are horizontally spaced apart from one another on the frame to define an open area therebetween above the frame, as seen in FIGS. 1-2. A linkage 38 connects first and second arm members, 34 and 36, respectively, such that when the arm members move, they move together. In the present described embodiment, arm member 34 is curved in shape and includes a first end 40 pivotably secured to the frame 16 and an unattached second end 42. Likewise, arm member 36 is curved in shape and includes a first end 44 pivotably secured to frame 16 and an unattached second end 46.

First and second arm members, 34 and 36, respectively are generally manufactured from a heavy duty rigid plastic material which is simple and inexpensive to manufacture into any desired shape and can easily include fun colors and patterns which are appealing to young users. In the present described embodiment, each arm member, 34 and 36, includes fun graphics and/or protrusions which are shaped to resemble race car wheels.

Linkage 38 is also generally manufactured from a heavy duty rigid plastic material, but can also include other materials such as metal and wood. Linkage 38 generally includes a rod spanning the width of the frame 16 and connects together arm members 34 and 36 at second ends 42 and 46, respectively, as seen in FIG. 1.

Figure 2A:
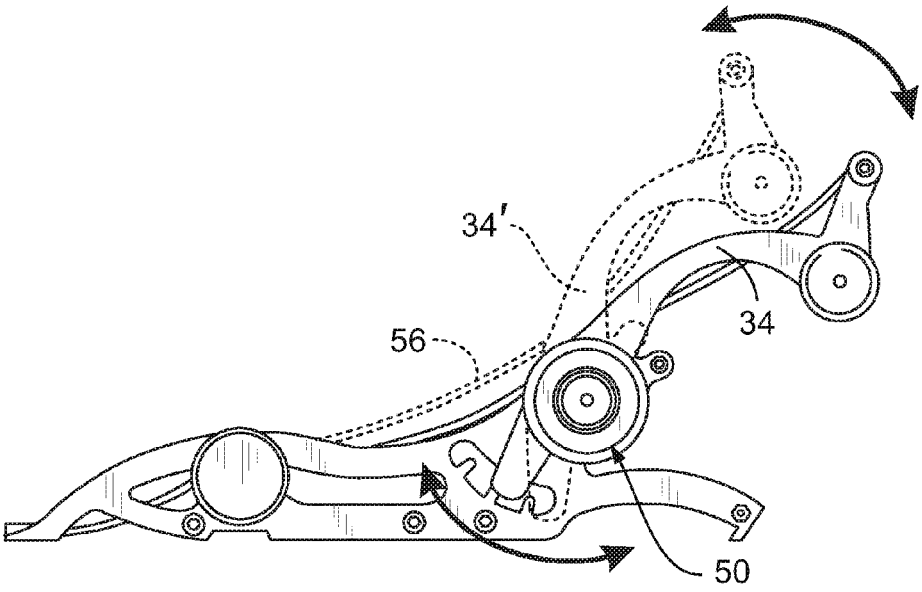
FIG. 2A is a side view of a toy of the present invention illustrating the arm members pivoting to various angles with respect to the frame and the attached bendable ramp adjusting to different positions, and FIG. 2B illustrating the arm members and attached bendable ramp nearly vertical with respect to the frame, with FIG. 2C illustrating the arm members and attached bendable ramp nearly horizontal with respect to the frame.

A first pivoting assembly 50, as seen in FIG. 1, at the frame 16, mechanically engages the first arm member 34 for adjustably pivoting the first arm member 34 between varying angles with respect to the frame. Likewise, a second pivoting assembly 52 at the frame 16 mechanically engages the second arm member 36 for adjustably pivoting the second arm member 36 between varying angles with respect to the frame. A rod 54 links first and second pivoting assemblies, 50 and 52, respectively, together, such that when the first pivoting assembly 50 is manually rotated by a user, the second pivoting assembly 52 will rotate in unison with the first assembly 50. As seen in FIG. 2A, arm member 34, along with linked arm member 36, are pivoted along pivoting assemblies 50 and 52, respectively, adjusting between a nearly vertical position, as seen in FIG. 2B and a nearly horizontal position, as seen in FIG. 2C.

A stop mechanism 58 at the frame 16 mechanically engages the first pivoting assembly 50 for locking the first pivoting assembly 50 into position and securing the arm members at a desired angle with respect to the frame, as seen in FIGS. 1-2. In the present described embodiment, the stop mechanism 58 further includes a pin 60 projecting from a lever element 62 which is in mechanical communication with the first pivoting assembly 50. A slot 64 at the frame 16 is further included for containing the pin 60 and limiting the pin rotation to between 0 and 45 degrees.

Figure 2B:
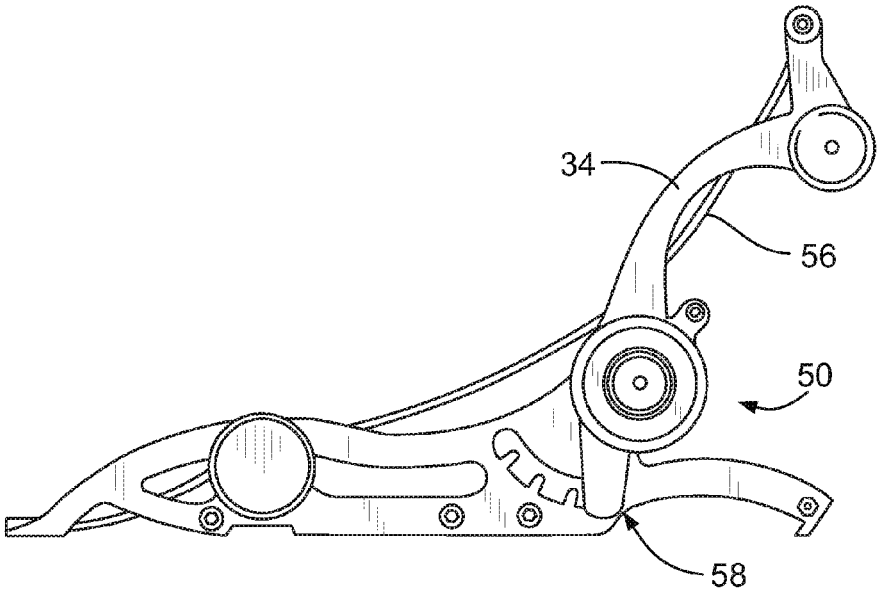
Figure 2C:
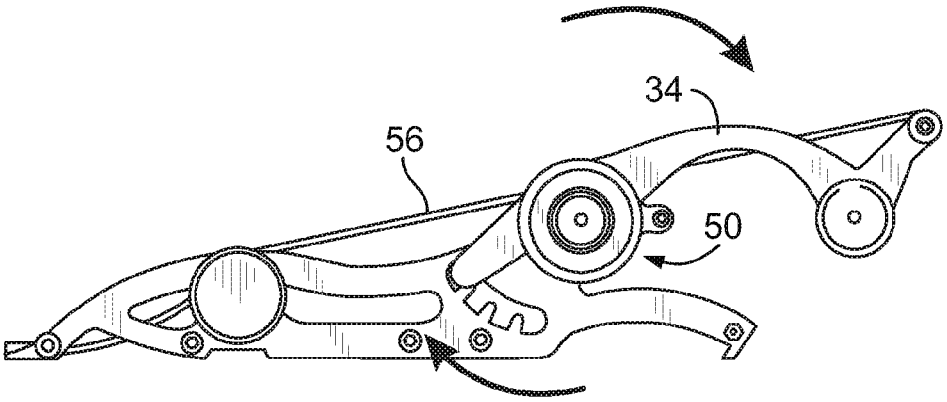

Also in the present described embodiment notches 64*a* in the slot 64 stop the rotating pin 60 at 0, 15, 30 and 45 degrees of rotation for locking the first pivoting assembly at multiple angles desired by a user, as seen in FIGS. 2A-2C. It is also contemplated that the first pivoting assembly 50 can be secured at almost any angle between 0 and 180 degrees with respect to the frame.

Figure 3:
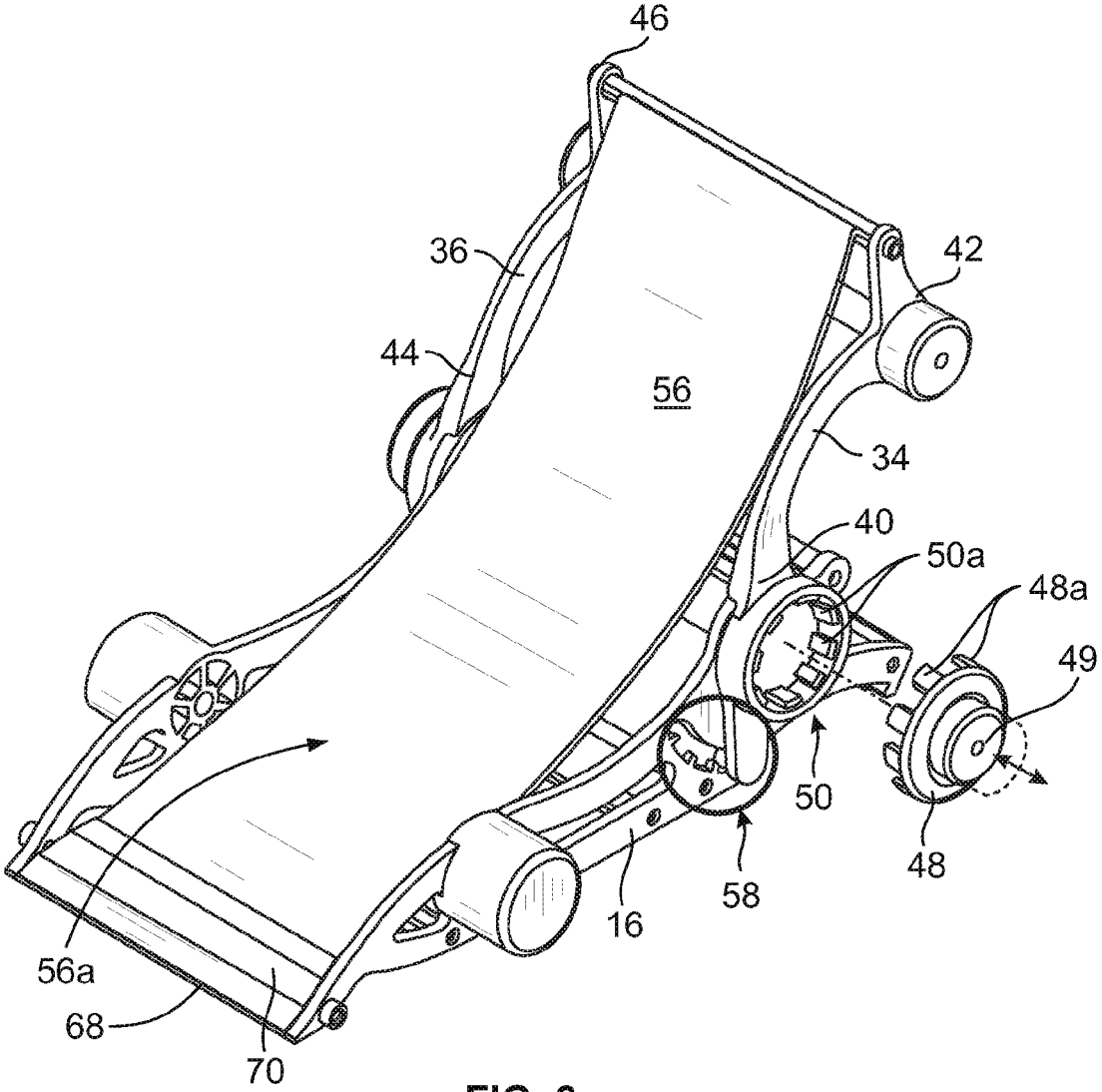
FIG. 3 illustrates the bendable ramp and ramp surface and a knob member with a button element contained therein for releasing a stop mechanism to freely rotate a first pivoting assembly.

The first pivoting assembly 50, further comprises a knob member 48 with a button element 49 contained therein for releasing the stop mechanism 58 to freely rotate the first pivoting assembly 50 to reposition the first arm member 34 and linked arm member 36 with respect to the frame 16. In the present described embodiment, as seen in FIG. 3, the knob member 48 includes numerous tabs 48*a* which release from protrusions 50*a* of the first pivoting assembly 50 when the button element 49 is pushed into the pivoting assembly 50, allowing the first pivoting assembly 50 to freely rotate. It is also contemplated that the knob member and button element can release the first pivoting assembly from a locked position though other mechanisms, such as a spring loaded button.

In use, button 49 is depressed by a user releasing the first pivoting assembly 50 to freely rotate between a 0 to 45 degree angle with respect to the frame simultaneously rotating lever 62 and projecting pin 60. At a desired location, the user releases button 49 locking pin 60 into a notch 64*a* at a desired point within slot 64 for ultimately locking first arm 34, and linked second arm 36, into a desired angle with respect to the frame 16. Though rotation of a single knob member 48 at the frame, a user can simply yet uniquely pivot the toy ramp 12.

A bendable ramp 56 is adjustably supported at the frame, as seen in FIGS. 1-3, and is secured to the arm members, 34 and 36 and sitting in the open area defined by the arm members and defined by the supporting members 20 and 22 of the frame. As described above, frame 16 is generally two halves, first and second supporting members 20 and 22, respectively. Extending from the supporting members, 20 and 22 are first and second arm members, 34 and 36, respectively, which can be seen to generally form two halves of the upper extension of the frame.

Together, the supporting members and arm members support and suspend the bendable ramp between the two halves of the frame. Suspension of the bendable ramp between two halves of the frame and arm members allows for great flexibility in altering the height and curvature of the ramp to move and curve in almost any orientation. Additionally, it is also contemplated that the two halves of the frame can includes multiple pivot points to further creatively modify the curvature of the suspended flexible ramp.

The height and curvature of the bendable ramp 56 is adjusted through rotation of the first pivoting assembly 50, which pivots arm member 34 to varying angles with respect to the frame. The ramp 56 includes a ramp surface 56*a*, as seen in FIG. 3, which adjusts between a first position which is nearly vertical with respect to the frame when the first pivoting assembly 50 is rotated to a first location, as seen in FIG. 2B, and a second position which is nearly horizontal with respect to the frame when the first pivoting assembly 50 is rotated to a second location, as seen in FIG. 2C.

Figure 4:
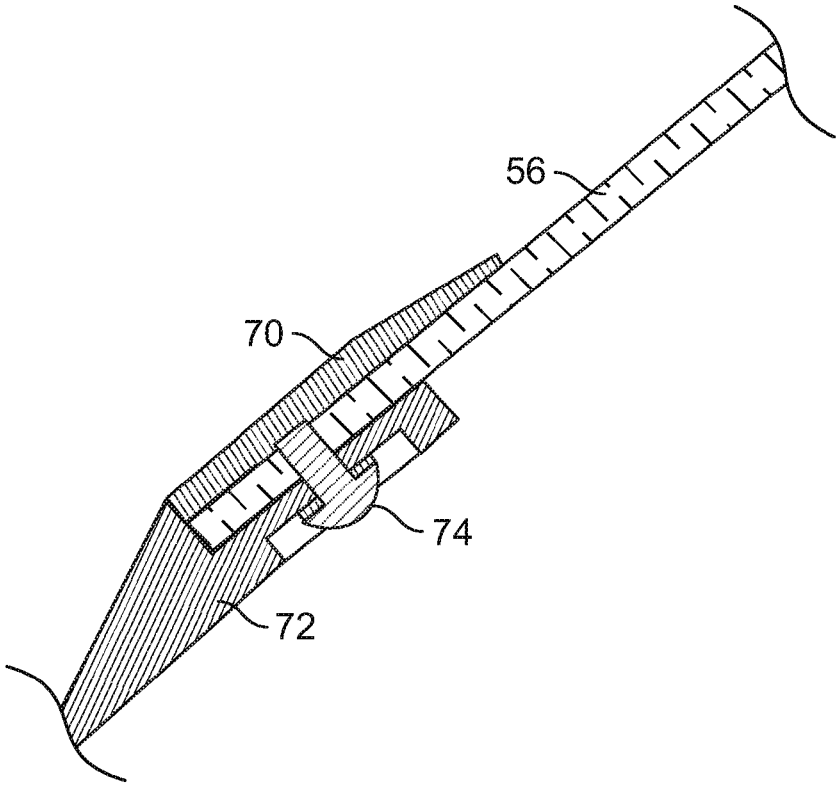
FIG. 4 illustrates a top plate and a bottom plate for securing an end of the ramp to the frame.

In the present described embodiment, the bendable ramp includes a stiff sheet of flexible plastic stretched out and secured to the first end 68 of the frame 16, opposite an end in mechanical communication with the first and second arm members, 34 and 36, respectively, as seen in FIGS. 1-3. The bendable ramp is stiff enough to hold the weight of a toy vehicle riding on the ramp surface 56*a*. A top plate 70 and a bottom plate 72 are further included at the first end 68 of the frame for capturing the flexible ramp 56 and securing the ramp to the frame, as seen in FIG. 4, which is a cross section along line 4-4 of FIG. 1. One or more screws 74 penetrate the bottom plate, top plate and flexible ramp to hold the ramp in place and secured to the frame 16.

Figure 5:
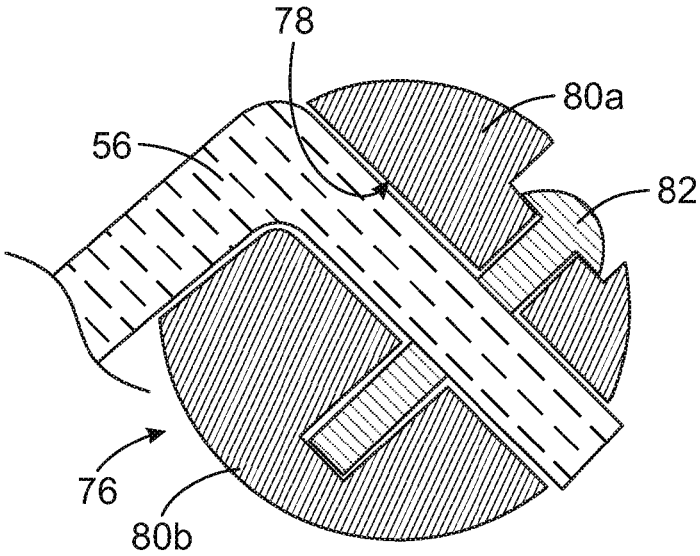
FIG. 5 illustrates a two piece rod shaped clamp for securing another end of the ramp to the arm members.

Also, in the present described embodiment, the plastic flexible ramp 56 is further secured at second ends 42 and 46, respectively, of the first and second arm members together, opposite ends 40 and 44, respectively, which are in mechanical communication with the frame 16, as seen in FIGS. 3 and 5. A two piece rod shaped clamp 76 is included at the second ends, 42 and 46 respectively, for securing the flexible ramp 56 to arm members 34 and 36, as seen in FIGS. 1 and 5.

In the present described embodiment, rod 80 is formed from two rod pieces 80*a* and 80*b*, as seen in FIG. 5, which is a cross section along line 5-5 of FIG. 1. Rod pieces 80*a* and 80*b* together define a slot 78, for capturing the flexible ramp 56 as it bends over rod piece 80*b* and slides into slot 78. Flexible ramp 56 secures to rod 80 with one or more screws 82, as seen in FIG. 5. Screws 82 penetrate rod piece 80*a*, the flexible ramp, and rod piece 80*b* at several points along rod 80, firmly securing the flexible ramp 56 to rod 80 at the second ends of the first and second arm members. Alternatively, it is also contemplated that rod 80 can rotate somewhat keeping ramp 56 at a desired tautness for toy vehicles to ride along ramp surface 56*a*.

In use, rotation of the single knob member 48 at the frame enables the user to simply yet uniquely vary the height and curvature of the flexible ramp surface uniquely supported on the pivoting ramp frame. For example, rotation of knob 48 and first pivoting assembly 50, to a first location, as seen in FIG. 2B, adjusts ramp surface 56*a* to a nearly vertical position where the ramp 56 is tallest. Alternatively, rotation of knob 48 and first pivoting assembly 50, to a second location, as seen in FIG. 2C, adjusts ramp surface 56*a* to a nearly horizontal position where the ramp 56 is shallowest.

Figure 6:
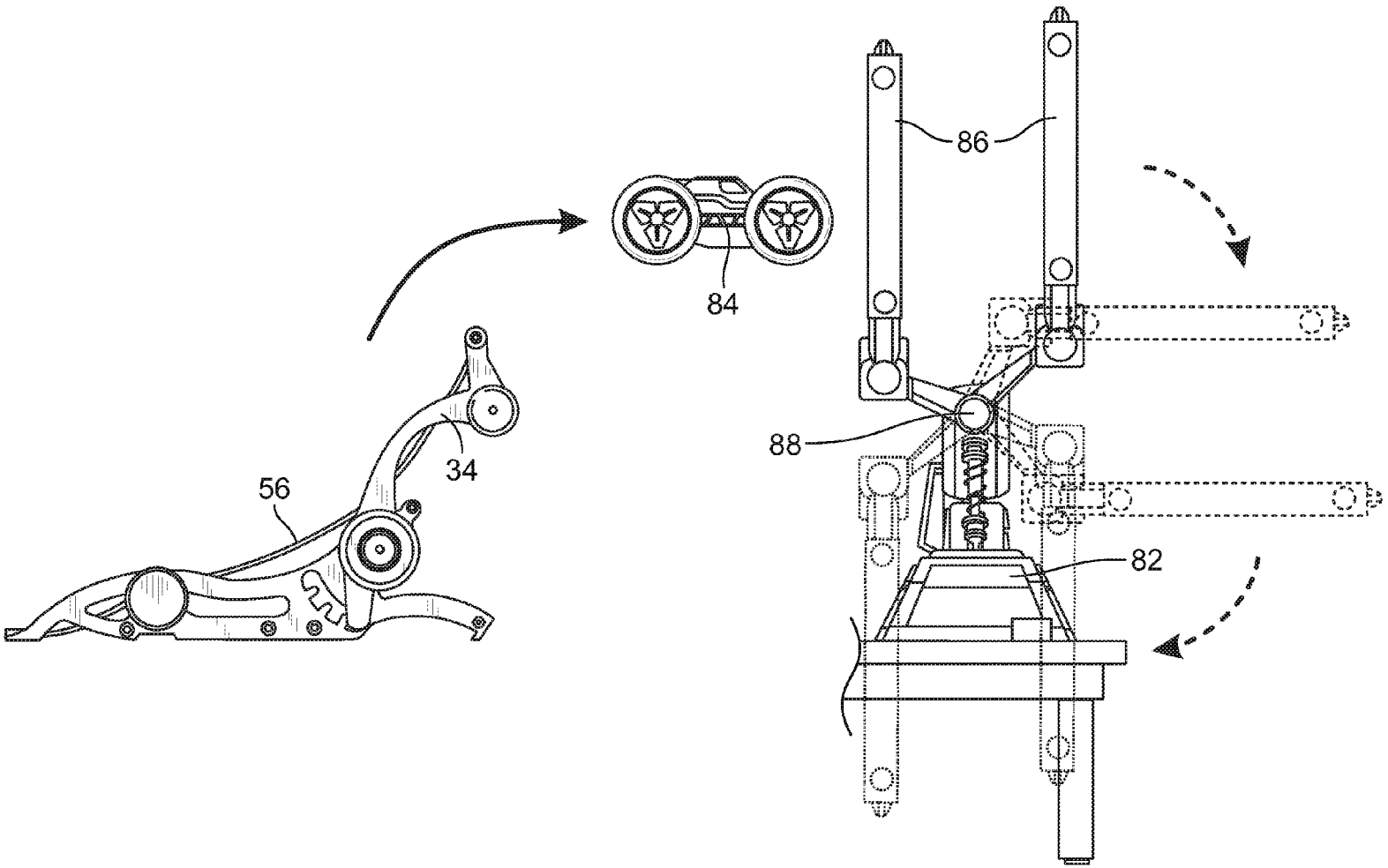
FIG. 6 illustrates a goal post assembly activated when a toy vehicle launched from the bendable ramp passes through the goal posts.

Additionally, a goal post assembly 82 including lights, sounds and IR sensors is included in a set containing the toy ramp 12 of the present described invention. The lights, sounds and IR sensors are activated when a toy vehicle 84 launched from the flexible ramp 56 passes through goal posts 86 of the goal post assembly 82, as seen in FIG. 6. As described above, the flexible ramp can adjust between a nearly vertical and a nearly horizontal position alternating the launch trajectory of the toy vehicle 84 to enhance fun for the user.

In a present described embodiment, the goal post assembly pivots at pivot point 88 to rotate the goal posts 86 between 0 and 180 degrees, as seen in FIG. 6. For example, the goal posts can point up and away from the supporting surface to provide a target for which the toy vehicle to jump through, or alternatively, the goal posts may point down and touch the supporting surface to provide a finish line for recording the land speed of the toy vehicle. Regardless of the position, the goal posts 86 sense when the vehicle 84 passes through and triggers lights and sounds using the IR sensors.

A method for adjusting a ramp frame and the height and curvature of a bendable ramp surface supported on the frame, includes the steps of providing a frame for resting on a horizontal surface, providing a first and a second arm member each extending upwardly from the frame, said first and second arm members being horizontally spaced apart from one another on the frame to define an open area therebetween above the frame, providing a first pivoting assembly at the frame mechanically engaging the first arm member for adjustably pivoting the first arm member between varying angles with respect to the frame, providing a second pivoting assembly at the frame mechanically engaging the second arm member for adjustably pivoting the second arm member between varying angles with respect to the frame, and providing a stop mechanism at the frame mechanically engaging the first pivoting assembly for locking the first pivoting assembly into position and securing the arm members at a desired angle with respect to the frame. Further provided is a bendable ramp adjustably supported at the frame, secured to the arm members and sitting in the open area defined by the arm members, the ramp including a ramp surface, and further including the step of adjusting the ramp surface between a first position, which is nearly vertical with respect to the frame, when the first assembly is rotated to a first location, and to a second position when the first pivoting assembly is rotated to a second location.

The method further includes the step of providing the second position of the bendable ramp surface to a nearly horizontal position with respect to the frame, and wherein the pivoting assembly further includes a knob member with a button element contained therein for releasing the stop mechanism to freely rotate the first pivoting assembly to reposition the first arm member and linked second arm member with respect to the frame. The method further includes a linkage connecting together first and second arm members such that the arm members move in unison.

Additionally, the method further includes providing the stop mechanism with a pin projecting from a lever element in mechanical communication with the first pivoting assembly. The method further includes the step of providing a slot at the frame for containing the pin and limiting the pin rotation to between 0 and 45 degrees for maintaining the first pivoting assembly at a desired angle with respect to the frame. The method also includes the step of providing the bendable ramp to include a stiff sheet of flexible plastic stretched out and secured to a first end of the frame opposite an end in mechanical communication with the first and second arm members, and the plastic is further secured to second ends of the first and second arm members together, opposite ends in mechanical communication with the frame.

From the foregoing, it can be seen that there has been provided a toy which simply yet uniquely varies the height and curvature of a flexible ramp surface uniquely supported on a pivoting ramp frame and adjusted though rotation of a single knob member at the frame. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy, comprising;

a frame for resting on a horizontal surface;

a first and a second arm member each extending upwardly from the frame, said first and second arm members being horizontally spaced apart from one another on the frame to define an open area therebetween above the frame;

a first pivoting assembly at the frame mechanically engaging the first arm member for adjustably pivoting the first arm member between varying angles with respect to the frame;

a second pivoting assembly at the frame mechanically engaging the second arm member for adjustably pivoting the second arm member between varying angles with respect to the frame;

a bendable ramp adjustably supported at the frame, secured to the arm members and sitting in the open area defined by the arm members, the ramp including a ramp surface that adjusts between a first position, which is nearly vertical with respect to the frame when the first pivoting assembly is rotated to a first location, and a second position when the first pivoting assembly is rotated to a second location; and a goal post assembly including lights, sounds and IR sensors which are activated when a toy vehicle launched from the bendable ramp passes through the goal posts.

2. The toy according to claim 1, wherein the second position of the bendable ramp surface is nearly horizontal with respect to the frame.

3. The toy according to claim 1, further comprising a stop mechanism at the frame mechanically engaging the first pivoting assembly for locking the first pivoting assembly into position and securing the arm members at a desired angle with respect to the frame.

4. The toy according to claim 3, wherein the first pivoting assembly further comprises a knob member with a button element contained therein for releasing the stop mechanism to freely rotate the first pivoting assembly to reposition the first arm member and linked second arm member with respect to the frame.

5. The toy according to claim 4, wherein the stop mechanism further comprises a pin projecting from a lever element which is in mechanical communication with the first pivoting assembly.

6. The toy according to claim 5, further comprising a slot at the frame for containing the pin and limiting the pin rotation to between 0 and 45 degrees.

7. The toy according to claim 1, wherein the bendable ramp comprises a stiff sheet of flexible plastic stretched out and secured to a first end of the frame opposite an end in mechanical communication with the first and second arm members, and the plastic is further secured at second ends of the first and second arm members together, opposite ends in mechanical communication with the frame.

8. The toy according to claim 7, further comprising a two piece rod shaped clamp at the second ends of the first and second arm members for securing the flexible ramp, and further comprising a top plate and a bottom plate at the first end of the frame for capturing the flexible ramp and securing the ramp to the frame.

9. A toy comprising:

a frame for resting on a horizontal surface;

a first and a second arm member each extending upwardly from the frame, said first and second arm members being horizontally spaced apart from one another on the frame to define an open area therebetween above the frame;

a first pivoting assembly at the frame mechanically engaging the first arm member for adjustably pivoting the first arm member between varying angles with respect to the frame;

a second pivoting assembly at the frame mechanically engaging the second arm member for adjustably pivoting the second arm member between varying angles with respect to the frame a stop mechanism at the frame mechanically engaging the first pivoting assembly for locking the first pivoting assembly into position and securing the arm members at a desired angle with respect to the frame; and a bendable ramp adjustably supported at the frame, secured to the arm members and sitting in the open area defined by the arm members, a two piece rod shaped clamp at the ends of the first and second arm members for securing the bendable ramp, and further comprising a top plate and a bottom plate at a first end of the frame for capturing the flexible ramp and securing the ramp to the frame, the ramp including a ramp surface which adjusts between positions.

10. The toy according to claim 9, wherein the pivoting assembly further comprises a knob member for releasing the stop mechanism to freely rotate the first pivoting assembly and reposition the first arm member with respect to the frame, and the stop mechanism further comprises a pin projecting from a lever element in mechanical communication with the first pivoting assembly.

11. The toy according to claim 10, further comprising a slot at the frame for containing the pin and limiting the pin rotation to between 0 and 45 degrees for maintaining the first pivoting assembly at a desired angle with respect to the frame.

12. The toy according to claim 9, further comprising a linkage connecting together first and second arm members such that the arm members move in unison.

13. The toy according to claim 9, wherein the bendable ramp comprises a stiff sheet of flexible plastic stretched out and secured to a first end of the frame, opposite an end in mechanical communication with the first and second arm members, and the plastic is further secured to second ends of the first and second arm members together, opposite ends in mechanical communication with the frame.

14. The toy according to claim 9, further comprising a goal assembly including an IR sensor which activates when a toy vehicle launched from the flexible ramp passes the goal assembly.

15. A toy, comprising;

a frame for resting on a horizontal surface;

a first and a second arm member each extending upwardly from the frame, said first and second arm members being horizontally spaced apart from one another on the frame to define an open area therebetween above the frame;

a first pivoting assembly at the frame mechanically engaging the first arm member for adjustably pivoting the first arm member between varying angles with respect to the frame;

a second pivoting assembly at the frame mechanically engaging the second arm member for adjustably pivoting the second arm member between varying angles with respect to the frame;

a stop mechanism at the frame mechanically engaging the first pivoting assembly for locking the first pivoting assembly into position and securing the arm members at a desired angle with respect to the frame;

a knob member for releasing the stop mechanism; and a bendable ramp comprising a stiff sheet of flexible plastic that is stretched out and supported between the frame and the arm members in the open area defined by the arm members, a two piece rod shaped clamp at the ends of the first and second arm members for securing the bendable ramp and further comprising a top plate and a bottom plate at a first end of the frame for capturing the flexible ramp and securing the ramp to the frame, the ramp including a ramp surface that adjusts from a first position, which is nearly vertical with respect to the frame when the first pivoting assembly is rotated to a first location, and a second position when the first pivoting assembly is rotated to a second location, wherein the first pivoting assembly and the knob member release the stop mechanism to freely rotate the first pivoting assembly to reposition the first arm member and linked second arm member with respect to the frame.

16. The toy according to claim 15, wherein the second position of the bendable ramp surface is nearly horizontal with respect to the frame.

17. The toy according to claim 15, wherein the stop mechanism further comprises a pin projecting from a lever element which is in mechanical communication with the first pivoting assembly.

18. The toy according to claim 17, further comprising a slot at the frame for containing the pin and limiting the pin rotation to between 0 and 45 degrees.

19. The toy according to claim 15, further comprising a goal post assembly including lights, sounds and IR sensors which are activated when a toy vehicle launched from the flexible ramp passes through the goal posts.

* * * * *